US008887827B2

(12) United States Patent
Simpson

(10) Patent No.: US 8,887,827 B2
(45) Date of Patent: Nov. 18, 2014

(54) MOUNTING ASSEMBLY FOR MOUNTING IMPLEMENT TO A VEHICLE

(71) Applicant: Pearson Engineering Limited, Newcastle upon Tyne (GB)

(72) Inventor: James Simpson, Houghton le Spring (GB)

(73) Assignee: Pearson Engineering Limited, Walker, Newcastle Upon Tyne (GB)

( * ) Notice: Subject to any disclaimer, the term of this patent is extended or adjusted under 35 U.S.C. 154(b) by 0 days.

(21) Appl. No.: 13/794,998

(22) Filed: Mar. 12, 2013

(65) Prior Publication Data

US 2013/0240226 A1 Sep. 19, 2013

(30) Foreign Application Priority Data

Mar. 16, 2012 (EP) ..... 12159895
Mar. 16, 2012 (GB) ..... 1204654.6

(51) Int. Cl.
*E02F 3/76* (2006.01)
*E02F 3/84* (2006.01)

(52) U.S. Cl.
CPC ..... *E02F 3/844* (2013.01); *E02F 3/7618* (2013.01); *E02F 3/7613* (2013.01)
USPC ..... 172/822; 172/810; 172/823

(58) Field of Classification Search
CPC ..... E02F 3/7613; E02F 3/7618; E02F 3/7609; E02F 3/844; A01B 59/064; E01H 5/06; E01H 5/061
USPC ..... 172/810, 811, 819–826, 439, 444, 446, 172/447; 37/283, 231, 234
See application file for complete search history.

(56) References Cited

U.S. PATENT DOCUMENTS

| | | | | |
|---|---|---|---|---|
| 2,643,472 | A | 6/1953 | Merz | |
| 2,766,536 | A * | 10/1956 | Perkins | 172/812 |
| 2,943,407 | A | 7/1960 | Long | |
| 3,011,276 | A | 12/1961 | Likely | |
| 3,628,612 | A | 12/1971 | Liess et al. | |
| 3,645,340 | A * | 2/1972 | Frisbee | 172/812 |
| 3,749,182 | A * | 7/1973 | Rockwell | 172/821 |
| 3,823,783 | A * | 7/1974 | Luedtke | 172/815 |
| 4,074,770 | A * | 2/1978 | Frisbee | 172/813 |

(Continued)

FOREIGN PATENT DOCUMENTS

| | | |
|---|---|---|
| JP | 47 011105 U | 10/1972 |
| JP | 49 049403 B | 12/1974 |

OTHER PUBLICATIONS

European Patent Office, Extended Search Report, European Application No. 12159895, dated Jul. 31, 2012.

*Primary Examiner* — Matthew D Troutman
(74) *Attorney, Agent, or Firm* — Kilpatrick Townsend & Stockton LLP

(57) ABSTRACT

A mounting assembly (6) for mounting a bulldozer blade (2) to a vehicle (4) is disclosed. The assembly comprises a lower link (8) adapted to be mounted to a vehicle, a pair of first actuators (16, 18) adapted to be pivotably mounted to the blade, and to a pair of link plates (24, 26) via respective pin joints (28, 30), and a pair of second actuators (36, 38) adapted to adjust the position of respective pin joints (28, 30) relative to the lower link to adjust the orientation of the blade relative to the vehicle.

10 Claims, 6 Drawing Sheets

(56) References Cited

U.S. PATENT DOCUMENTS

| | | | | | |
|---|---|---|---|---|---|
| 4,270,617 | A | * | 6/1981 | Cantarella et al. | 172/821 |
| 4,405,019 | A | * | 9/1983 | Frisbee | 172/816 |
| RE31,642 | E | * | 8/1984 | Asal et al. | 172/821 |
| 4,828,044 | A | * | 5/1989 | Horsch et al. | 172/821 |
| 4,962,816 | A | * | 10/1990 | Imon et al. | 172/821 |
| 5,799,737 | A | * | 9/1998 | Kamikawa et al. | 172/2 |
| 5,974,702 | A | * | 11/1999 | Donoghue | 37/263 |
| 6,059,048 | A | * | 5/2000 | Subrt | 172/821 |
| 6,827,155 | B1 | * | 12/2004 | Hoffart | 172/821 |
| 7,021,398 | B1 | * | 4/2006 | Marshall | 172/788 |

* cited by examiner

MOUNTING ASSEMBLY FOR MOUNTING IMPLEMENT TO A VEHICLE

CROSS-REFERENCE TO RELATED APPLICATIONS

This application claims priority to European Patent Application No. EP 12159895, filed Mar. 16, 2012, titled "Mounting Assembly for Mounting Implement to a Vehicle," and UK Patent Application No. GB 1204654.6 filed on Mar. 16, 2012, the contents of both of which are hereby incorporated by reference in their entireties herein.

FIELD

The present invention relates to a mounting assembly for mounting an implement to a vehicle, and relates particularly, but not exclusively, to a mounting assembly for mounting a bulldozer blade to a military work vehicle.

BACKGROUND

Blade mounting assemblies for mounting bulldozer blades to vehicle bodies are known. These often include mechanisms which allow the lift (height of the blade relative to the vehicle), pitch (orientation of the blade about an axis generally normal to the vehicle centre line plane), angle (orientation of the blade about a generally vertical axis) and tilt (orientation of the blade about a generally horizontal axis parallel to the vehicle centre line plane) to be adjusted for particular operations. Military work vehicles generally operate as conventional bulldozers, i.e. clearing debris, filling holes and so on, but in some cases also function as "earth anchors" in which the blade is buried deeply in the ground to provide a secure anchor to allow the vehicle, fitted with a suitable winch, to recover other vehicles stuck in soft terrain.

Since the blade is generally designed to be fitted to heavy vehicles, the assembly may be subjected to very high loads. For example, if the edge of the blade strikes a sufficiently immovable obstacle while bulldozing, the vehicle will be stopped almost instantly. The loads in the assembly in such a situation may be very large compared to normal bulldozing loads.

At the same time, it is also desirable to be able to adjust blade angle, for example when clearing snow from a carriageway to a roadside. In one known arrangement, one or more powered actuators are connected between the blade and a frame in order to rotate the blade relative to the frame. Such arrangements suffer from the disadvantage that when the blade is facing straight ahead, the actuator cylinders are partly extended, usually at their mid-point of travel, and actuators are then further extended and/or contracted to turn the blade left or right from its mid position. The blade is typically held rigidly in the mid position by locking the actuators. Since hydraulic cylinders are usually used as actuators, these are locked by closing hydraulic valves connected to the cylinder ports, preventing oil leaving or entering the cylinder, and thus preventing the cylinders extending or contracting. In order to avoid damage to the cylinders by excess pressure or buckling, hydraulic circuits typically include pressure relief valves which override this lock if a sufficiently high external force results in hydraulic pressures above some set threshold value, for example as a result of the blade edge striking some sufficiently immovable object and if the moving vehicle has sufficient mass and speed.

Such arrangements suffer from the disadvantage that in order to increase the size of load which the assembly can withstand, larger hydraulic cylinders need to be used, which significantly increases the weight and volume of the assembly.

SUMMARY

Preferred embodiments of the present invention seek to overcome the above disadvantage of the prior art.

According to an aspect of the present invention, there is provided a mounting assembly for mounting an implement to a vehicle, the assembly comprising:— a body adapted to be mounted to a vehicle;

at least one pair of first actuators; each said first actuator being adapted to be pivotably mounted, at a respective first pivot, to one of said body or an implement;

a plurality of first link members, each said first link member being pivotably mounted, at a respective second pivot, to a respective said first actuator and adapted to be pivotably mounted, at a respective third pivot, to the other of said body or said implement;

characterised by a plurality of second actuators, each said second actuator being adapted to adjust the position of a respective said second pivot relative to the body to adjust the orientation of the implement relative to the vehicle, wherein at least one said first link member and the corresponding said first actuator are arranged in use such that a line directly connecting said first and second pivots is arranged at an obtuse angle to a line directly connecting said second and third pivots, and at least one said second actuator is adapted to move the corresponding said second pivot from one side of a line directly joining the corresponding said first and third pivots to the other side of said line.

By providing first link members pivotably mounted at respective second pivots to first actuators and second actuators for adjusting the position said second pivots relative to the body to adjust the orientation of the implement relative to the vehicle, this provides the advantage of enabling the distance between the implement and an adjacent part of the vehicle to be reduced by means other than reducing the length of one or more of the first actuators. As a result, the implement can be in its angular mid position with fully compressed first actuators, which provides the advantage of significantly increasing the compressive forces which the assembly can withstand by means of actuators of a given size, as a result of which a lighter and more compact mounting assembly can be used for a given load.

This also provides the advantage of enabling compressive loads tending to cause the obtuse angle to change to be resisted by means of a more compact second actuator when in tension, thereby further contributing to reduction in weight and volume of the assembly.

This also provides the advantage of enabling the angle of the implement relative to the vehicle to be adjusted by means of a more compact assembly.

At least one said first link member and the corresponding said first actuator may be arranged such that loads urging the implement towards the vehicle in use tend to decrease the size of said obtuse angle.

At least one said second actuator may be arranged such that loads urging the implement towards the vehicle in use cause tensile loading of said second actuator.

This provides the advantage of enabling the loads to be resisted by means of a more compact second actuator.

At least one said second actuator may be pivotably mounted at a respective fourth pivot to said body.

The assembly may further comprise at least one third actuator for adjusting the orientation of the body relative to the vehicle.

At least one said third actuator may be adapted to cause pivoting of the implement relative to the vehicle about a first axis, and said first and second actuators may be adapted to cooperate to cause pivoting of the implement relative to the vehicle about a second axis substantially perpendicular to said first axis.

At least one said third actuator may be adapted to be pivotably mounted relative to the vehicle and to the implement.

The assembly may comprise a plurality of said third actuators.

This provides the advantage of providing a further degree of freedom of pivoting of the implement relative to the vehicle, by means of extending at least one said third actuator and/or contracting at least one said third actuator.

The assembly may further comprise at least one second link member adapted to be pivotably mounted relative to the implement and to the vehicle to adjust the orientation of the implement relative to the body as the orientation of the body relative to the vehicle changes.

This provides the advantage of enabling automatic pitch control of the implement when the implement is a bulldozer blade without the need for an additional actuator, thereby minimising increases in weight and volume of the assembly.

According to another aspect of the present invention, there is provided a vehicle comprising:

a vehicle body;

an implement; and a mounting assembly as defined above connected to said vehicle body and said implement.

BRIEF DESCRIPTION OF THE DRAWINGS

A preferred embodiment of the invention will now be described, by way of example only, and not in any limitative sense, with reference to the accompanying drawings, in which:—

DETAILED DESCRIPTION

Figure 1:
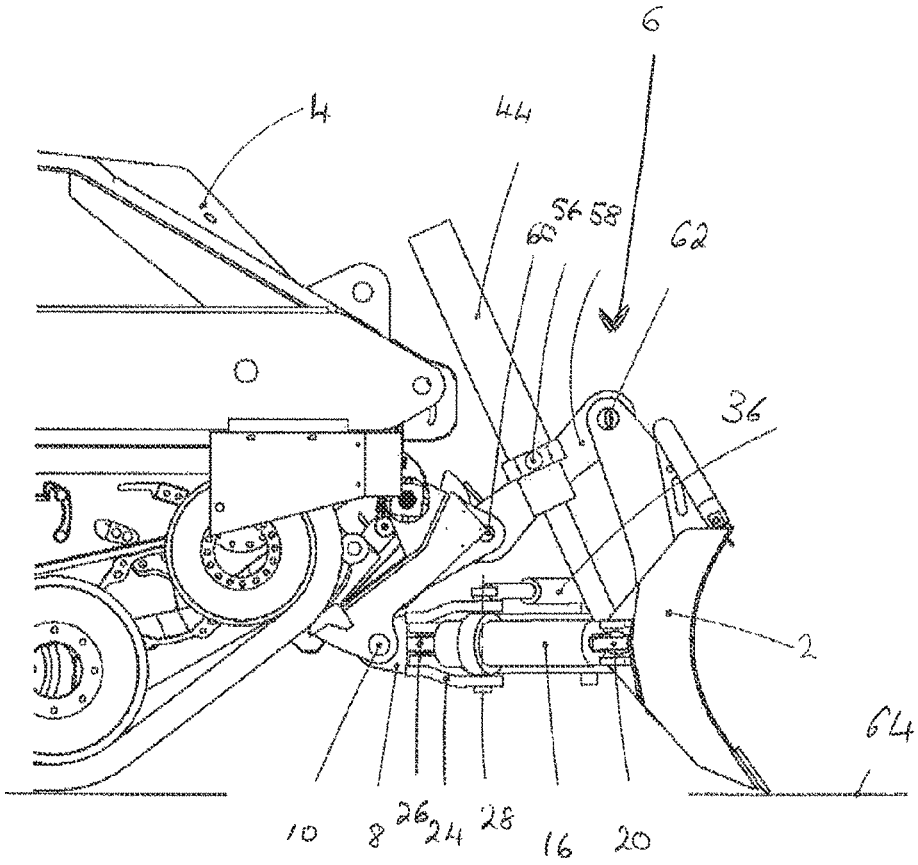
FIG. 1 is a side view of a bulldozer blade attached to a vehicle by means of a mounting assembly embodying the present invention and with the blade level with a nominal ground plane.
Figure 2:
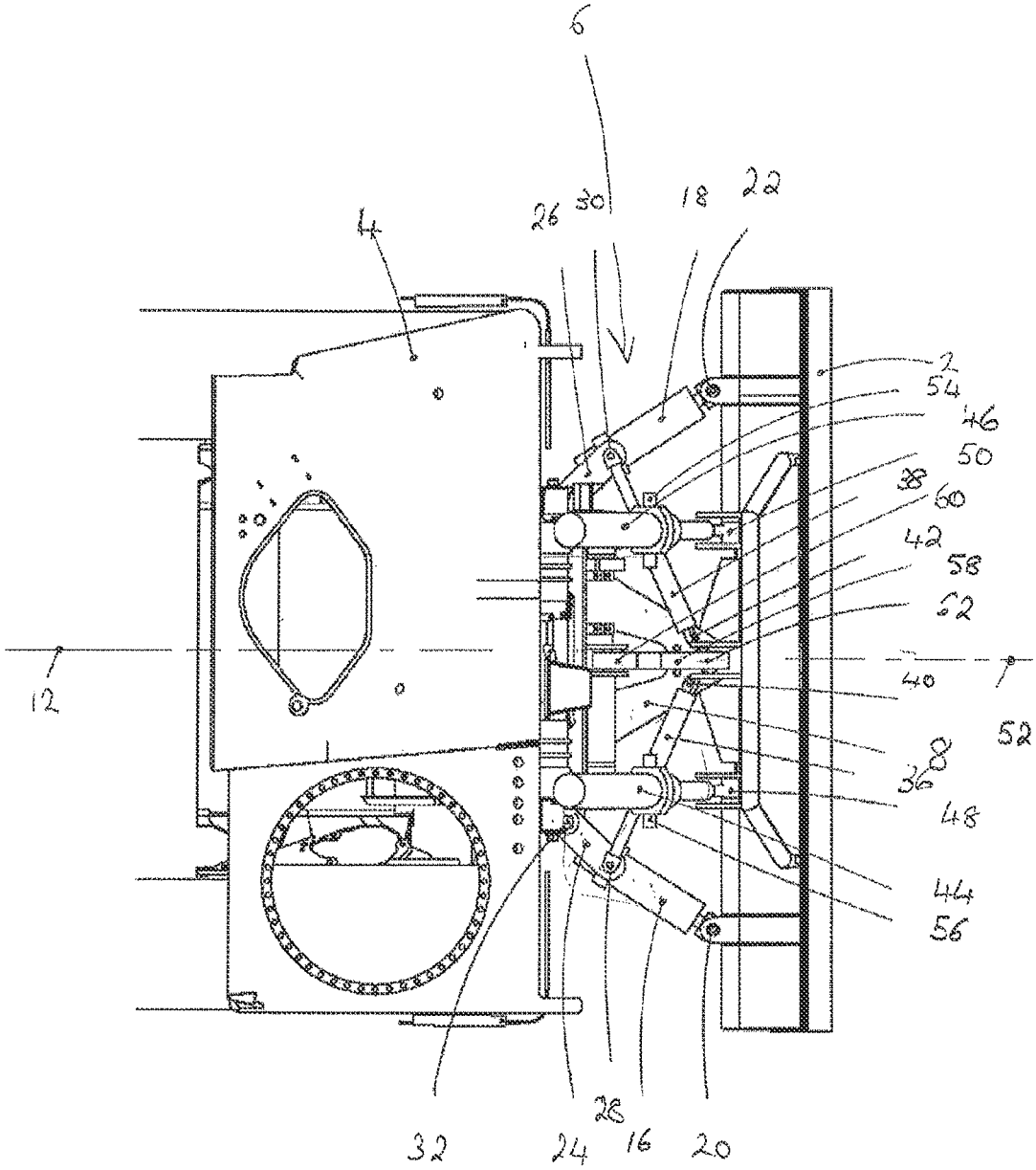
FIG. 2 is a plan view of the arrangement of FIG. 1.
Figure 5:
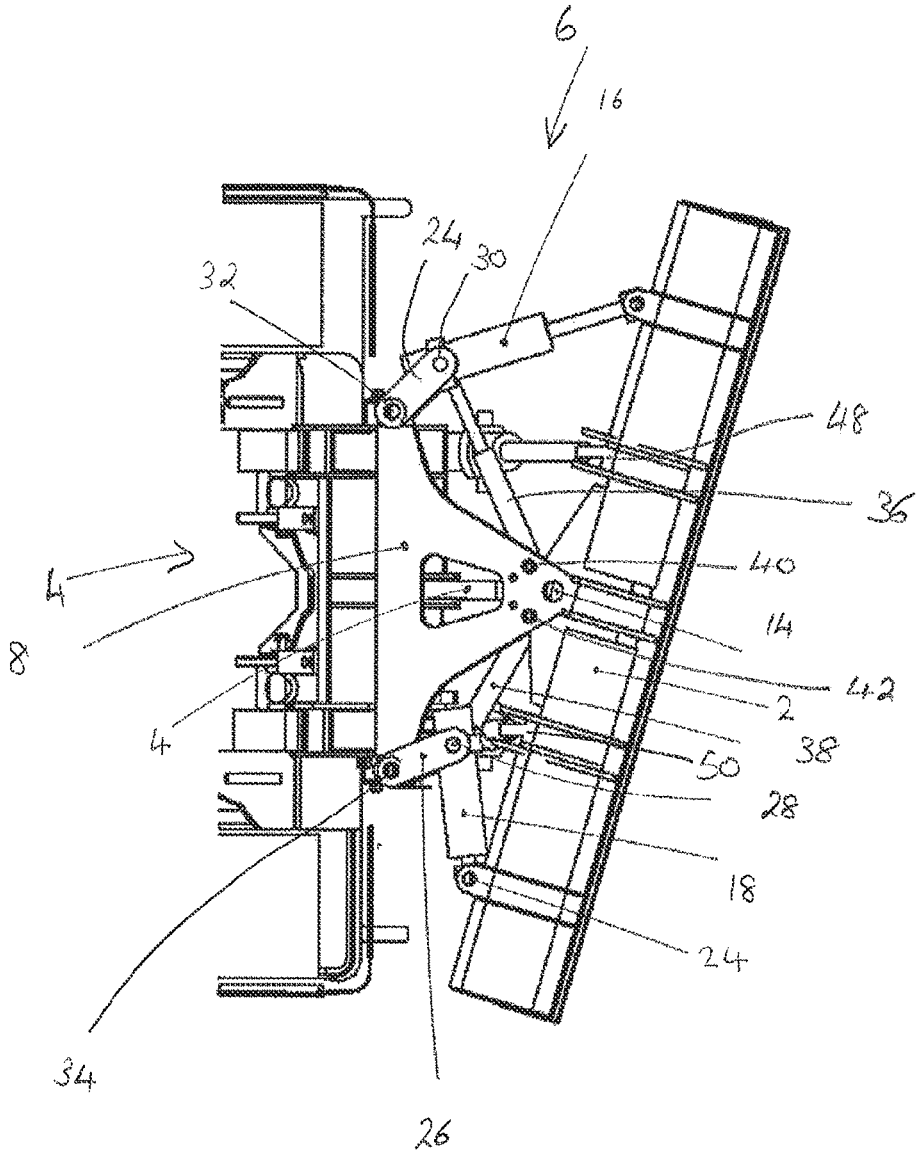
FIG. 5 is a view from below of the arrangement of FIG. 1 with the blade angled to one side.

Referring to FIGS. 1, 2 and 5, a bulldozer blade 2 is attached to a vehicle 4 by means of a mounting assembly 6 embodying the present invention. The assembly 6 comprises a body in the form of a lower link 8 connected to the vehicle 4 by means of a pin joint 10, the axis of the pin joint 10 being generally perpendicular to a vehicle centre line plane 12 (FIG. 2). The lower link 8 is connected the blade 2 by means of a ball joint 14 (FIG. 5).

A pair of first actuators 16, 18 are connected to the blade 2 by respective ball joints 20, 22 and to respective first link members in the form of link plates 24, 26 by means of respective pin joints 28, 30. The link plates 24, 26 are connected to the lower link 8 by means of respective ball joints 32, 34 (FIG. 5). A pair of second actuators 36, 38 are connected to the lower link 8 by respective ball joints 40, 42 and to the respective link plates 24, 26 and actuators 16, 18 at the respective pin joints 28, 30 such that the actuators 16, 18 and respective link plates 24, 26 form respective obtuse angles to each other in the arrangement shown in FIG. 2. As a result, high loads tending to urge the blade 2 towards the vehicle 4 will result in high compressive loads in the actuators 16, 18 and link plates 24, 26 tending to urge the respective pin joints 28, 30 outwardly to reduce the size of the respective obtuse angles, this movement being resisted by tensile loads in the respective actuators 36, 38 which can be resisted by means of a more compact actuator design, since actuators are more effective in tension than in compression.

A pair of third actuators 44, 46 are connected to the blade 4 by respective "point on line" joints 48, 50. As will be appreciated by persons skilled in the art, a "point on line" joint is a joint having one translational degree of freedom and three rotational degrees of freedom, for example a plain spherical bearing which can slide along a pin. In the arrangement shown in FIG. 2, the axis of the translational degree of freedom is fixed normal to the centre line plane 52 of the blade 2. Left actuator 46 is connected to the vehicle 4 by means of a pin joint 54, the structure connecting the pin joint 54 to the vehicle body being omitted from the Figures for clarity, and the axis of the pin joint 54 is generally perpendicular to the vehicle centre line plane 12. Similarly, right actuator 44 is connected to the blade 2 by "point on line" joint 48 and to the vehicle body by means of a pin joint 56. Again, the structure connecting the pin joint 56 to the vehicle body is omitted from the Figures for clarity.

Figure 3:
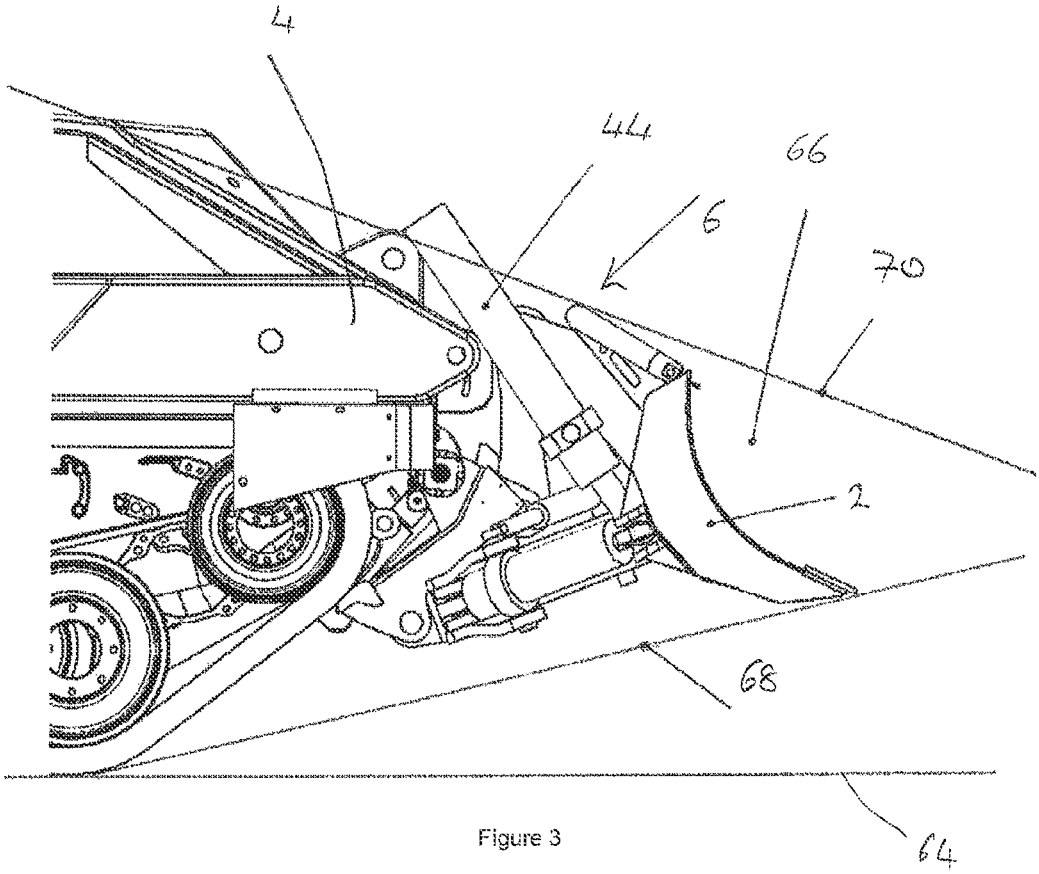
FIG. 3 is a side view of the arrangement of FIG. 1 with the blade in a raised position for travelling between work locations.

A top link 58 is attached to the vehicle body by means of a ball joint 60 and to the bulldozer blade 2 by means of a ball joint 62. Referring to FIG. 3, the blade 2 is raised relative to ground plane 64 by retraction of actuators 44, 46 so that the blade 2 and mounting assembly 6 fit within an envelope 66 bounded by an approach angle plane 68 and a sight or gun line plane 70. This enables the apparatus to be effectively stowed when not in use.

Figure 4:
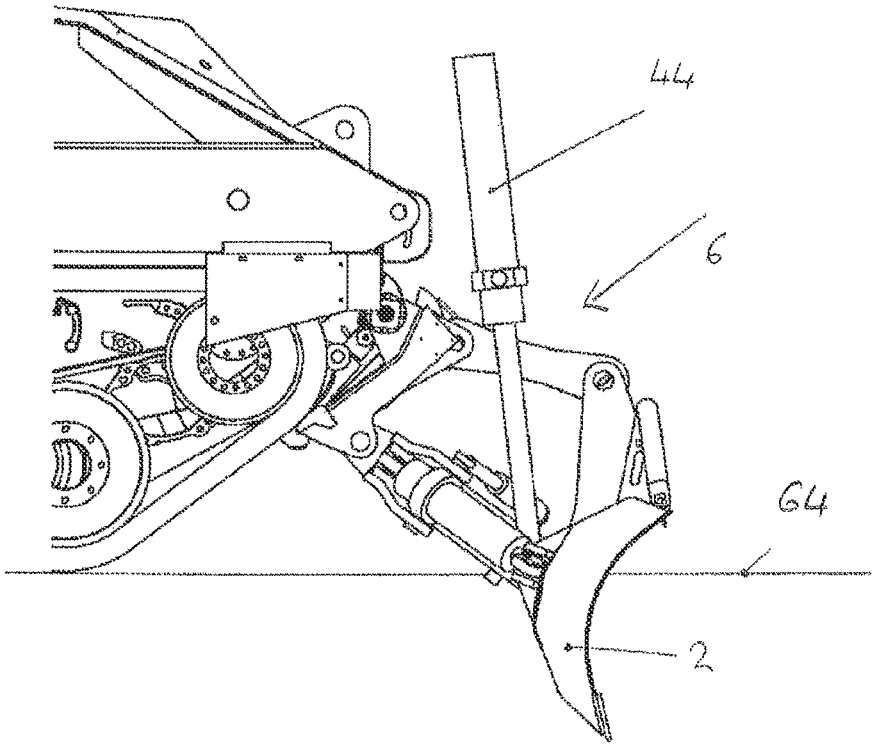
FIG. 4 is a side view of the arrangement of FIG. 1 with the blade in a lowered position for earth anchoring.

Referring now to FIG. 4, extension of the actuators 44, 46 causes the assembly 6 to lower the blade 2 deeply below the nominal ground plane 64. This enables secure earth anchoring to be carried out.

Referring to FIGS. 2 and 5, in order to adjust the angle of the blade 2 relative to the vehicle 4 body, one of the second actuator 36 is extended and the other second actuator 38 is contracted. This urges one pin joint 30 outwardly of the assembly 6 and withdraws the other pin joint 28 inwardly, as a result of which the respective first actuators 16, 18 and corresponding link plates 24, 26 pivot relative to each other. As can be seen from FIG. 5, the pin joint 28 moves from one side of a line directly connecting the ball joints 24, 34 to the other side of that line, thereby enabling the distance between the blade 2 and the adjacent part of the vehicle 4 to be reduced by means other than retraction of the actuator 18. This movement is also assisted by means of connection of the lower link 8 to the blade 2 by means of ball joint 14. Since the blade 2 is also connected to the upper link 58 by means of a ball joint 62, the blade 2 can rotate about an axis passing through the ball joints 14, 62.

Figure 6:
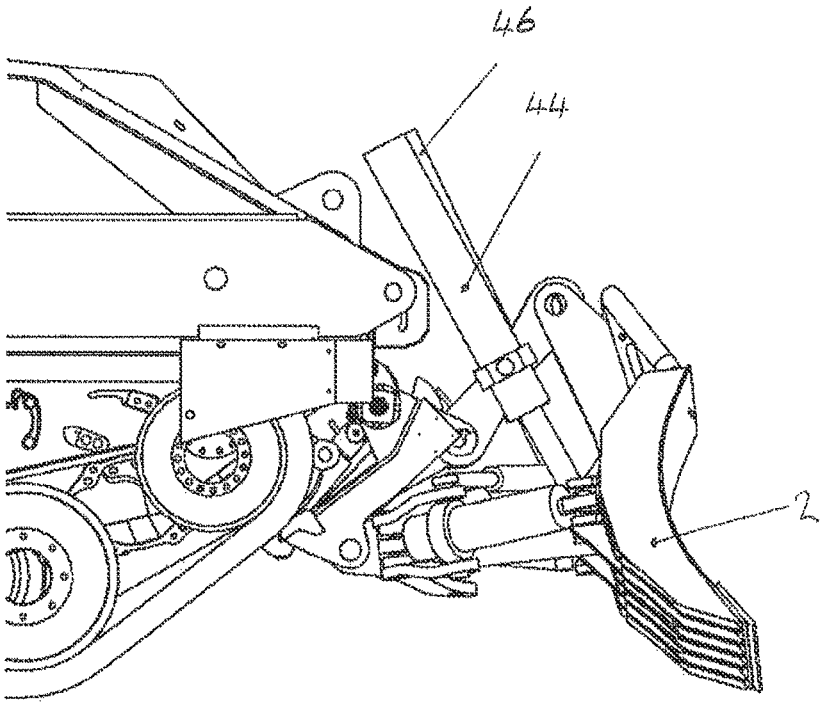
FIG. 6 is a side view of the arrangement of FIG. 1 with the blade in a tilted position for breaking through a hard surface.

Finally, referring to FIG. 6, by extending one of the third actuators 44, 46 and contracting the other actuator, the blade 2 can be arranged in a tilted position for penetrating hard ground.

It will be appreciated by persons skilled in the art that the above embodiment has been described by way of example only, and not in any limitative sense, and that various alterations and modifications are possible without departure from the scope of the invention as defined by the appended claims.

The invention claimed is:

1. A mounting assembly for mounting an implement to a vehicle, the assembly comprising:

a body adapted to be mounted to the vehicle;

at least one pair of first actuators, each of said first actuators being adapted to be pivotably mounted, at a respective first pivot, to one of said body or the implement;

a plurality of first link members, each of said first link members being pivotably mounted, at a respective second pivot, to a respective said first actuator and adapted to be pivotably mounted, at a respective third pivot, to the other of said body or said implement; and a plurality of second actuators, each of said second actuators being adapted to adjust the position of a corresponding said second pivot relative to the body to adjust the orientation of the implement relative to the vehicle, wherein at least one of said first link members and said first actuator pivotably mounted thereto are arranged in use such that a line directly connecting said first and second pivots is arranged at an obtuse angle to a line directly connecting said second and third pivots, and at least one of said second actuators is adapted to move the corresponding said second pivot from one side of a line directly joining said first and third pivots to the other side of said line.

2. The assembly according to claim 1, wherein at least one of said first link members and the corresponding said first actuator are arranged such that loads urging a said first pivot towards a said third pivot connected thereto via a said first actuator and a said link member in use tend to decrease the size of said obtuse angle.

3. The assembly according to claim 1, wherein at least one of said second actuators is arranged such that loads urging a said first pivot towards a said third pivot connected thereto via a said first actuator and a said link member in use cause tensile loading of said second actuator.

4. The assembly according to claim 1, wherein at least one of said second actuators is pivotably mounted at a respective fourth pivot to said body.

5. The assembly according to claim 1, further comprising at least one third actuator for adjusting the orientation of the body relative to the vehicle.

6. The assembly according to claim 5, wherein said third actuator is adapted to cause pivoting of the implement relative to the vehicle about a first axis, and said first and second actuators are adapted to cooperate to cause pivoting of the implement relative to the vehicle about a second axis substantially perpendicular to said first axis.

7. The assembly according to claim 5, wherein said third actuator is adapted to be pivotably mounted relative to the vehicle and to the implement.

8. The assembly according to claim 5, wherein said at least one third actuator comprises a plurality of said third actuators.

9. The assembly according to claim 1, further comprising at least one second link member adapted to be pivotably mounted relative to the implement and to the vehicle to adjust the orientation of the implement relative to the body as the orientation of the body relative to the vehicle changes.

10. A vehicle comprising:

a vehicle body;

an implement; and a mounting assembly according to claim 1 connected to said vehicle body and said implement.

* * * * *